US009008336B2

(12) United States Patent
Akino

(10) Patent No.: US 9,008,336 B2
(45) Date of Patent: Apr. 14, 2015

(54) CONDENSER MICROPHONE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 406 days.

(21) Appl. No.: 13/644,196

(22) Filed: Oct. 3, 2012

(65) Prior Publication Data

US 2013/0089222 A1 Apr. 11, 2013

(30) Foreign Application Priority Data

Oct. 6, 2011 (JP) ..... 2011-221762

(51) Int. Cl.

| | |
|---|---|
| ***H04R 25/00*** | (2006.01) |
| ***H04R 3/06*** | (2006.01) |
| *H04R 19/04* | (2006.01) |
| *H04R 3/02* | (2006.01) |
| *H04R 19/01* | (2006.01) |

(52) U.S. Cl.
CPC *H04R 3/06* (2013.01); *H04R 19/04* (2013.01); *H04R 3/02* (2013.01); *H04R 19/016* (2013.01)

(58) Field of Classification Search
CPC ..... H04R 3/06; H04R 3/10; H04R 19/01; H04R 19/04; H04R 19/016; H04R 21/02
USPC ..... 381/174
See application file for complete search history.

(56) References Cited

U.S. PATENT DOCUMENTS

2011/0228954 A1* 9/2011 Saulespurens et al. ..... 381/113

FOREIGN PATENT DOCUMENTS

DE 20319202 U1 * 5/2005
JP 2006-295357 10/2006

* cited by examiner

*Primary Examiner* — Duc Nguyen
*Assistant Examiner* — Kile Blair
(74) *Attorney, Agent, or Firm* — Whitham Curtis Christofferson & Cook, PC

(57) ABSTRACT

The present invention has: a condenser microphone unit which performs electroacoustic conversion according to a change in an electrostatic capacitance between a diaphragm and a fixed pole; a non-inverting amplifier which is connected to one of the diaphragm and the fixed pole, and which has an impedance converter which converts an output impedance of the microphone unit into a low impedance; an inverting amplifier which receives an input of an output signal of the non-inverting amplifier through an input resistance, and which has a feedback resistance; and a variable resistor which is connected between an output of the non-inverting amplifier and an output of the inverting amplifier, and in which a wiper is connected to the diaphragm or the fixed pole, whichever is not connected to the non-inverting amplifier, and the sensitivity changes according to the position of the wiper of the variable resistor.

8 Claims, 6 Drawing Sheets

CONDENSER MICROPHONE

BACKGROUND OF THE INVENTION

1. Field of the Invention

The present invention relates to a condenser microphone which can adjust variation in the sensitivity between individuals without changing an electrostatic absorption force between a diaphragm and a fixed pole.

2. Description of Related Art

A condenser microphone has a diaphragm and a fixed pole which oppose to each other with a predetermined gap, and outputs as an acoustic signal a change in an electrostatic capacity between the diaphragm and the fixed pole due to vibration of the diaphragm upon reception of an acoustic wave. There is a direct current bias condenser microphone which applies a direct current voltage to a condenser formed with a diaphragm and a fixed pole. The sensitivity of the direct current bias condenser microphone depends on a bias voltage, and, when the bias voltage is higher, the sensitivity is higher. Hence, there is a direct current bias condenser microphone which can adjust the sensitivity by adjusting a bias voltage. FIG. 6 illustrates an example of a circuit diagram of a condenser microphone of a relevant technique.

In FIG. 6, the condenser microphone unit 15 has a diaphragm 151 and a fixed pole 152 which oppose to each other with an adequate gap, and, when the diaphragm 151 receives an acoustic wave and vibrates, the acoustic wave is electroacoustically converted as described above and is outputted as acoustic signals from the diaphragm 151 and the fixed pole 152. The fixed pole 152 is connected to a direct current voltage source 16. Further, the diaphragm 151 is connected to a non-inverting input terminal of an amplifier 11. The amplifier 11 has an impedance converter formed with a FET (Field Effect Transistor), and converts an output signal of a condenser microphone unit 15 of a very high impedance into a low impedance signal and outputs the signal to the next stage.

An output terminal of the amplifier 11 is connected to an inverting input terminal of an inverting amplifier 12 which is a second amplifier, through an input resistance R10. A non-inverting input terminal of the inverting amplifier 12 is connected to an earth through a condenser C12. A feedback resistance R11 is connected between the inverting input terminal and the output terminal of the inverting amplifier 12. A resistance value of the input resistance R10 and a resistance value of the feedback resistance R11 are equal. Here, a voltage gain of the inverting amplifier 12 is −1.

The output terminal of the amplifier 11 is connected to a non-inverting input terminal of a third amplifier 13. The output terminal of the inverting amplifier 12 is connected to a non-inverting input terminal of a fourth amplifier 14. The output terminal of the amplifier 13 is connected to a second pin 22 of a connector employing a three-pin configuration. Further, the output terminal of the amplifier 13 is connected to the inverting input terminal of the amplifier 13. An output terminal of the amplifier 14 is connected to a third pin 23 of the connector, and is connected to the inverting input terminal of the amplifier 14. The connector is a connector for a balanced output. That is, the second pin 22 connected to the output terminal of the amplifier 13 is a hot-side output pin of a balanced output, the third pin 23 connected to the output terminal of the amplifier 14 is a cold-side output pin of a balanced output, and the first pin 21 is an earth pin.

A positive power supply terminal of each amplifier 11, 12, 13 and 14 is connected to a positive power supply output terminal of a direct current power supply 16, and a negative power supply terminal of each amplifier 11, 12, 13 and 14, an earth terminal of the direct current power supply 16 and the first pin 21 of the connector are connected to each other. Further, the direct current voltage outputted from the direct current power supply 16 is connected so as to be applied to the diaphragm of the condenser microphone unit 15 as a direct current bias voltage. The direct current bias voltage can be adjusted by operating a variable resistor VR11 which the direct current power supply 16 has. The variable resistor VR11 is configured to be capable of adjusting the sensitivity of the condenser microphone unit 15 upon this adjustment.

Thus, the direct current bias condenser microphone can adjust the sensitivity by adjusting the direct current bias voltage. However, with the direct bias condenser microphone, when a bias voltage is increased, an electrostatic absorption force produced between a diaphragm and a fixed pole increases, and the diaphragm is absorbed to the fixed pole. Hence, the diaphragm cannot vibrate, and therefore the direct current bias condenser microphone does not function as a microphone in some cases.

Further, with the direct current bias condenser microphone, even when the diaphragm is not electrostatically absorbed to the fixed pole by the bias voltage, if a strong air current hits the diaphragm, the diaphragm is more likely to be electrostatically absorbed to the fixed pole. Hence, by taking stability of an operation into account, a bias voltage is set at such a level that electrostatic absorption does not occur even if a strong air current hits the diaphragm. If it is possible to make the direct bias voltage continuously variable, it is possible to make the sensitivity of the condenser microphone continuously variable. By so doing, the direct current condenser microphone can set an adequate bias voltage at which the direct current condenser microphone can stably operate without electrostatic absorption even if a strong air current hits the diaphragm.

For example, an electret condenser microphone in which an electret layer is formed on the surface of a fixed pole does not need to be applied a direct current bias, and does not need a direct current bias generating circuit. However, in order to make the sensitivity of the electret condenser microphone, a configuration needs to be employed where the electret layer on the surface of the fixed pole is exposed, and a surface voltage of the electret layer is adjusted.

The applicant of the present invention proposed an electret condenser microphone which can adjust the sensitivity by making a direct current voltage to be applied variable (see Japanese Patent Application Laid-Open No. 2006-295357). Although the electret condenser microphone disclosed in Japanese Patent Application Laid-Open No. 2006-295357 can adjust the sensitivity, when a direct current voltage to be applied is increased too high, the diaphragm is more likely to be electrostatically absorbed to the fixed pole, and thus there is a limitation for increasing the sensitivity. Therefore, it is desired that a condenser microphone which can adjust the sensitivity without changing the voltage between the diaphragm and the fixed pole is realized.

Incidentally, condenser microphones have variation in the sensitivity per individual, and quality of condenser microphones is made uniform in sensitivity adjusting process in manufacturing process. The direct current bias condenser microphone can remove the variation in the sensitivity by adjusting the direct current bias voltage. However, adjusting the direct current bias voltage involves the above problem, and there is also a problem that frequency response characteristics fluctuate. Hence, it is desired that a condenser microphone which can adjust the sensitivity without changing a polarization potential upon adjustment for removing the sensitivity per individual is realized.

SUMMARY OF THE INVENTION

It is an object of the present invention to provide a condenser microphone which can adjust the sensitivity without changing a polarization potential and preventing a problem of electrostatic absorption of a diaphragm and fluctuation of acoustic characteristic caused when the sensitivity is increased.

A condenser microphone according to the present invention has: a condenser microphone unit which has a diaphragm and a fixed pole arranged to oppose to each other, and performs electroacoustic conversion according to a change in an electrostatic capacitance between the diaphragm and the fixed pole; a non-inverting amplifier which is connected to one of the diaphragm and the fixed pole, and which has an impedance converter which converts an output impedance of the condenser microphone unit into a low impedance; an inverting amplifier which receives an input of an output signal of the non-inverting amplifier through an input resistance, and which has a feedback resistance; and a variable resistor which is connected between an output of the non-inverting amplifier and an output of the inverting amplifier, and in which a wiper is connected to the diaphragm or the fixed pole, whichever is not connected to the non-inverting amplifier.

DETAILED DESCRIPTION OF EMBODIMENTS

Hereinafter, Embodiments of a condenser microphone according to the present invention will be described with reference to the drawings.

Embodiment 1

Figure 1:
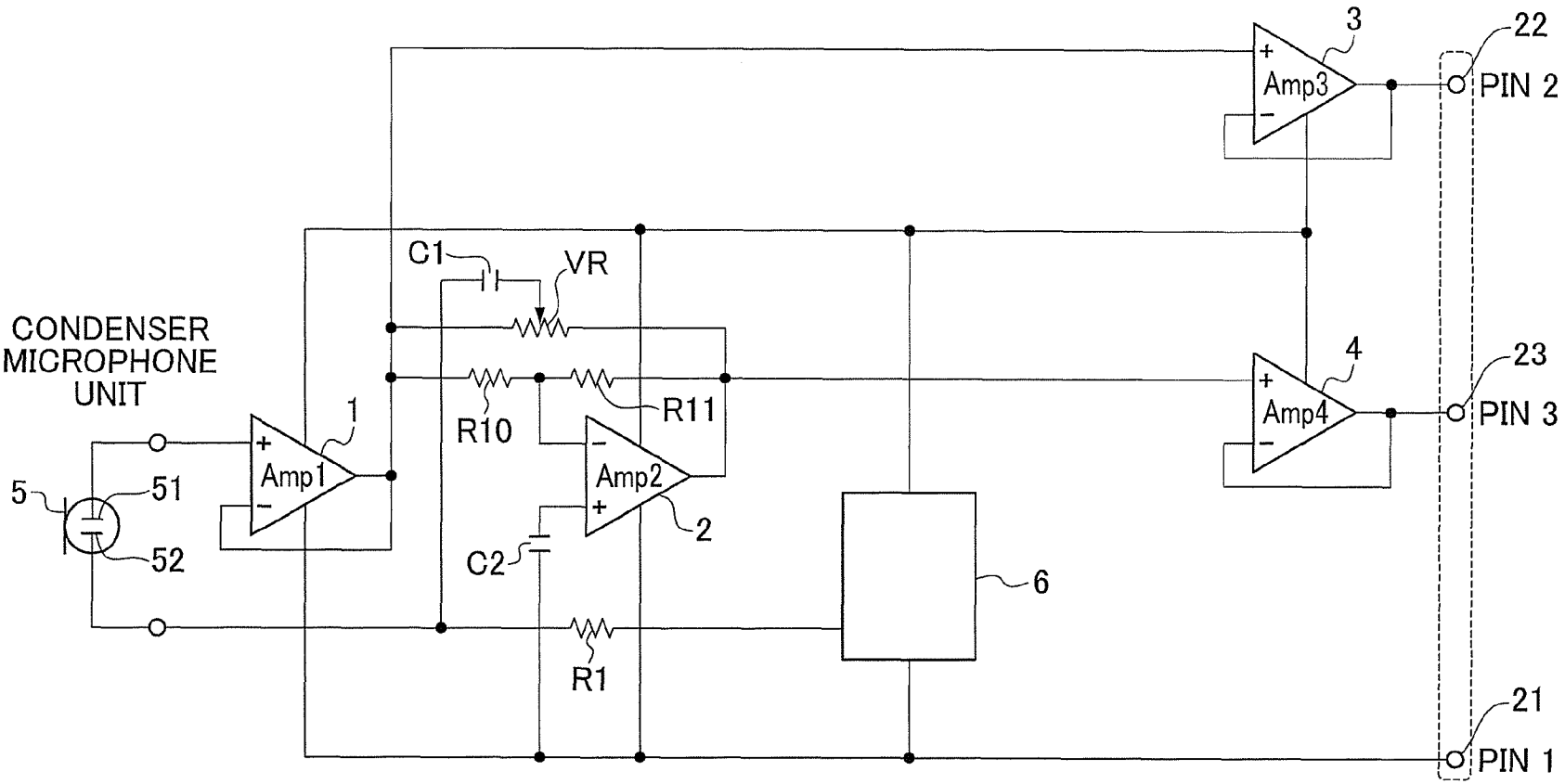
FIG. 1 is a circuit diagram illustrating Embodiment of a condenser microphone according to the present invention.

In FIG. 1, a condenser microphone unit 5 has a diaphragm 52 and a fixed pole 51 which oppose to each other with an adequate gap. The diaphragm 52 and the fixed pole 51 form electrodes of a condenser. When the diaphragm 52 receives an acoustic wave and vibrates, the electrostatic capacitance of the condenser changes, and acoustic signals corresponding to the acoustic wave are outputted from the diaphragm 52 and the fixed pole 51. The fixed pole 51 is connected to a non-inverting input terminal of a first amplifier 1. The diaphragm 52 is applied a direct current voltage from a direct current power supply 6 through a resistance R1.

The direct current power supply 6 has a DC-DC converter which boosts the voltage of a power supply battery built in a microphone to, for example, about 100 V at maximum. However, the direct current power supply 6 is not limited to a built-in battery. When, for example, a phantom power supply is introduced, a phantom power supply may be used. Further, whether or not to use a DC-DC converter is arbitrary. That is, as long as a necessary voltage can be secured, a DC-DC converter may not be necessarily used. A voltage applied from the direct current power supply 6 to the diaphragm 52 of the condenser microphone unit 5 is fixed.

The first amplifier 1 has an impedance converter which is mainly formed with a FET, and converts a signal of a very high output impedance outputted from the condenser microphone unit 5 into a signal of a low impedance and outputs the signal to the next stage. An output terminal of the amplifier 1 is connected to an inverting input terminal of an inverting amplifier 2 which is a second amplifier, through an input resistance R10. A non-inverting input terminal of the inverting amplifier 2 is connected to an earth through a condenser C2. A feedback resistance R11 is connected between the inverting input terminal and the output terminal of the inverting amplifier 2. A resistance value of the input resistance R10 and a resistance value of the feedback resistance R11 are equal. A voltage gain of the inverting amplifier 2 is set to −1.

The output terminal of the amplifier 1 is connected to a non-inverting input terminal of a third amplifier 3. Further, the output terminal of the inverting amplifier 2 is connected to a non-inverting input terminal of a fourth amplifier 4. The output terminal of the amplifier 3 is connected to a second pin 22 of the connector employing a three-pin configuration. Further, the output terminal of the amplifier 3 is connected to the inverting input terminal of the amplifier 3. An output terminal of the amplifier 4 is connected to a third pin 23 of the connector. Further, the output terminal of the amplifier 4 is connected to the inverting input terminal of the amplifier 4. The connector is a connector for a balanced output, and the second pin 22 connected to the output terminal of the amplifier 3 is a hot-side output pin of a balanced output, the third pin 23 connected to the output terminal of the amplifier 4 is a cold-side output pin of a balanced output, and the first pin 21 is an earth pin.

A variable resistor VR is connected between an output of the non-inverting amplifier 1 which is the first amplifier and an output of the inverting amplifier 2 which is the second amplifier. More specifically, one of both terminals of the variable resistor VR is connected to the output terminal of the non-inverting amplifier 1, and the other one of both terminals of the variable resistor VR is connected to the output terminal of the inverting amplifier 2. Hence, the variable resistor VR is connected in parallel to the input resistance R10 and the feedback resistance R11 connected in series. A wiper of the variable resistor VR is connected to the diaphragm 52 or the fixed pole 51 of the condenser microphone unit 5, whichever is not connected to the non-inverting amplifier 1. In the illustrated example, the wiper is connected to the diaphragm 52 through the condenser C1.

A positive power supply terminal of each amplifier 1, 2, 3 and 4 is connected to a positive power supply output terminal of the direct current power supply 6. A negative power supply terminal of each amplifier 1, 2, 3 and 4, an earth terminal of the direct current power supply 6, and the first pin 21 of the connector are connected to each other. Each amplifier 1, 2, 3 and 4 connected in this way receives a supply of power for operating each amplifier 1, 2, 3 and 4, from the direct current power supply 6.

According to Embodiment of the condenser microphone illustrated in FIG. 1, a voltage for driving the diaphragm 52 of the condenser microphone unit 5 changes according to a position of the wiper of the variable resistor VR, and the sensitivity of the microphone changes. In other words, the voltage applied to an acoustic signal which is electroacoustically converted by the condenser microphone unit 5 and is outputted is adjusted to plus or minus according to the position of the wiper of the variable resistor VR, and the sensitivity of the microphone changes. Even if the sensitivity of the microphone is adjusted in this way, the voltage (polarization potential) to be applied between the fixed pole 51 and the diaphragm 52 of the microphone unit 5 does not fluctuate, and is fixed. Hence, according to Embodiment of the condenser microphone illustrated in FIG. 1, problems do not occur that, as in a conventional technique, a diaphragm is more likely to be electrostatically absorbed due to sensitivity adjustment and acoustic characteristics fluctuate.

Figure 3:
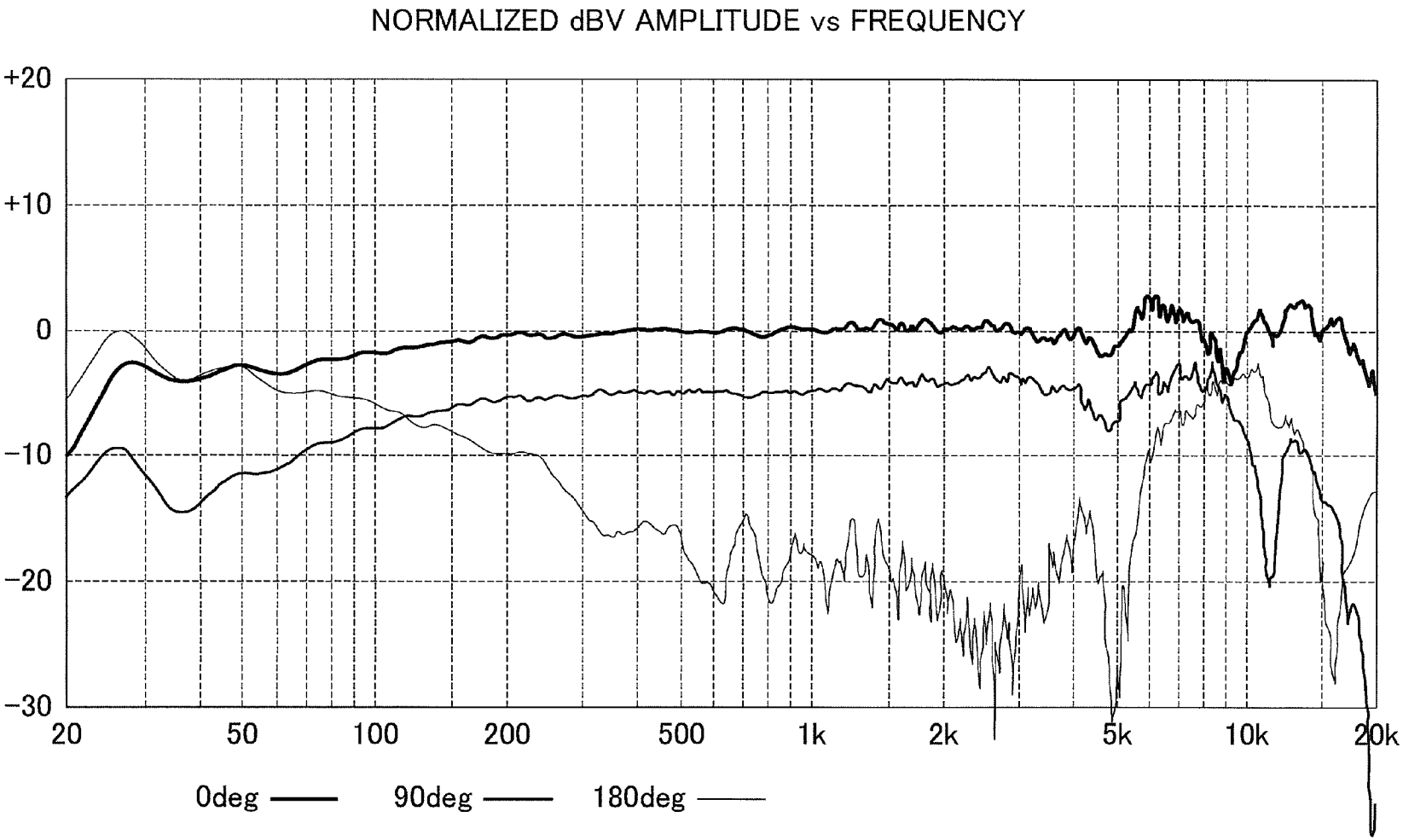
FIG. 3 is a frequency response characteristic diagram when a sensitivity adjustment position is set in the center according to Embodiment.
Figure 4:
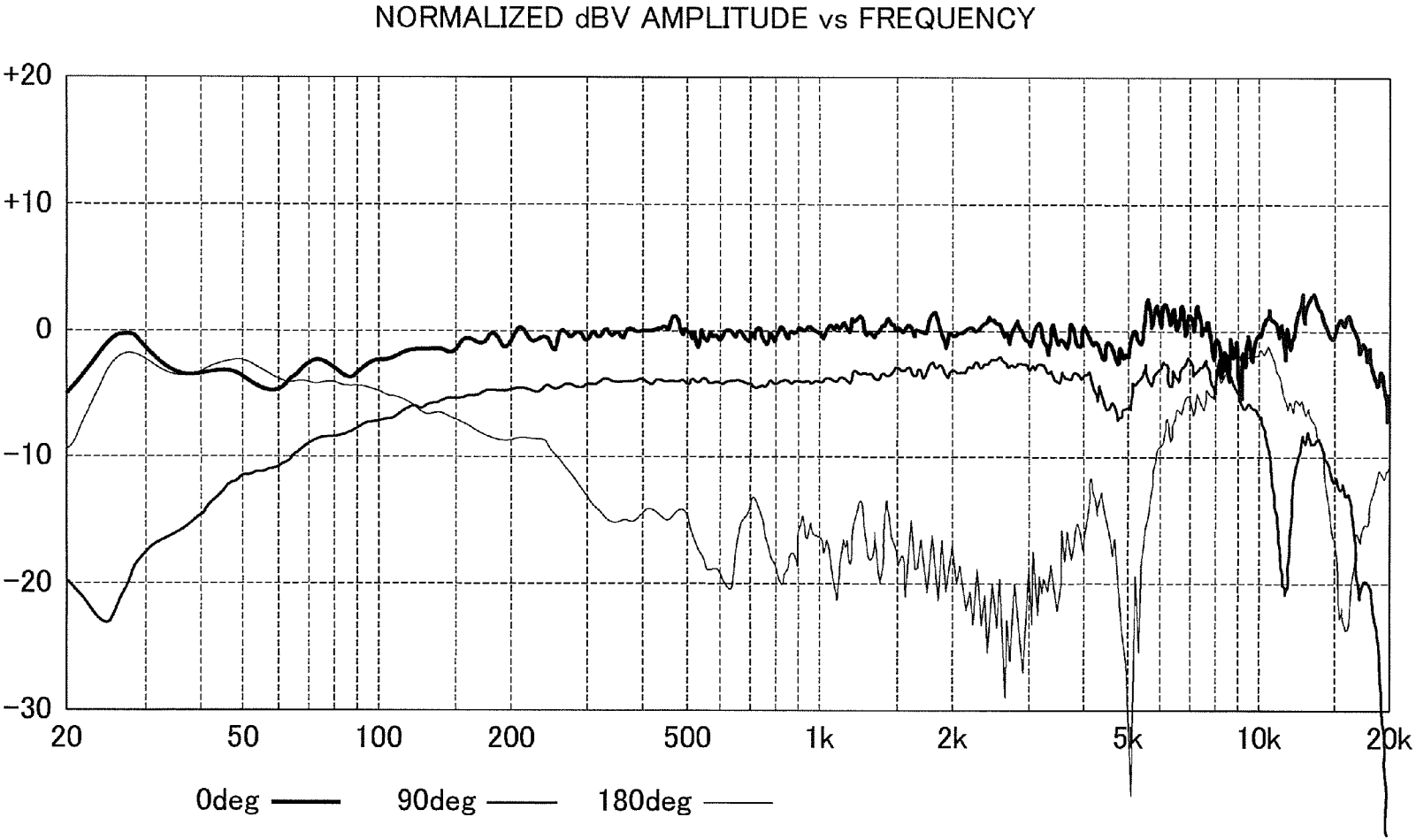
FIG. 4 is a frequency response characteristic diagram when the sensitivity adjustment position is set on a high sensitivity side according to Embodiment.
Figure 5:
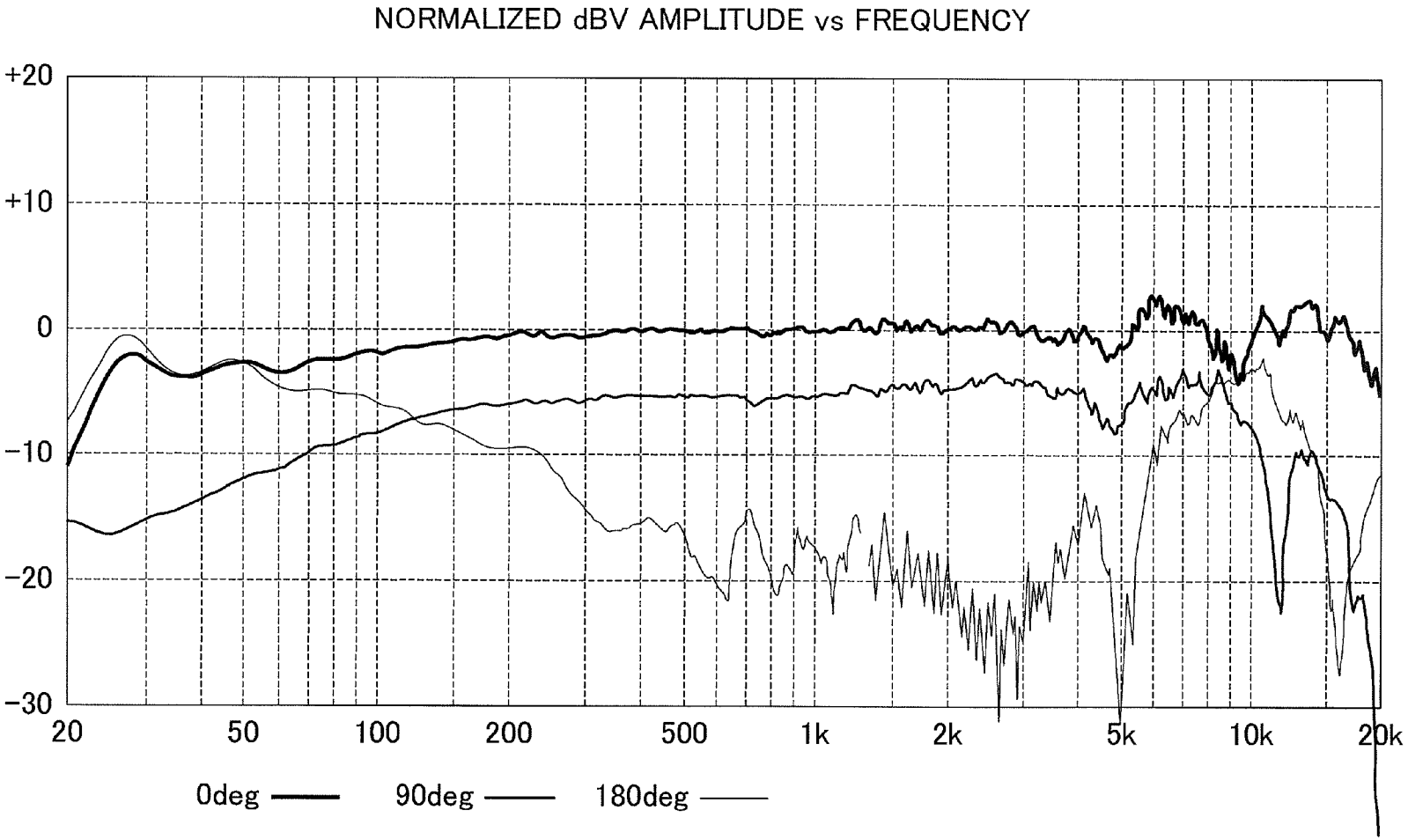
FIG. 5 is a frequency response characteristic diagram when the sensitivity adjustment position is set to a low sensitivity according to Embodiment.
Figure 6:
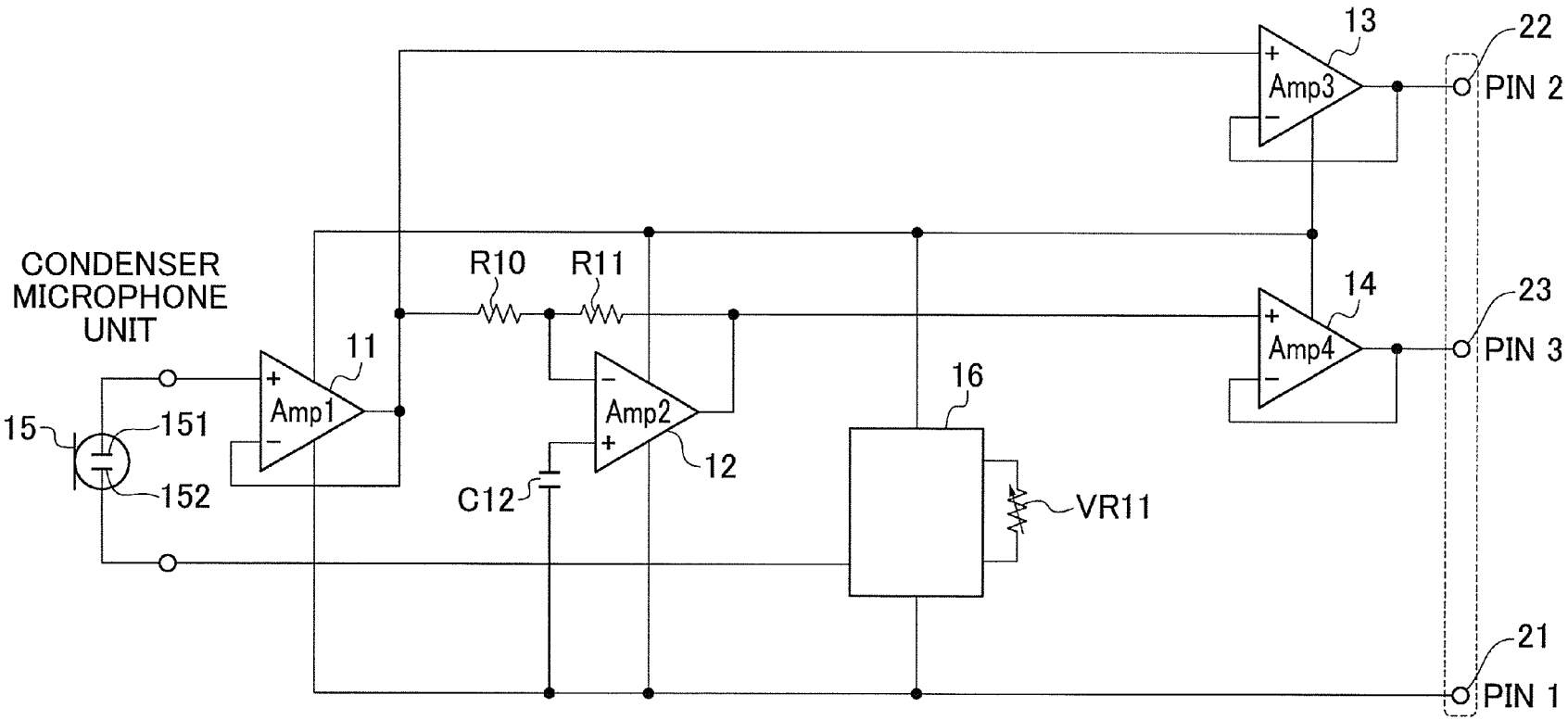
FIG. 6 (Related Art)
FIG. 6 is a circuit diagram illustrating an example of a condenser microphone of a technique related to the present invention.

FIGS. 3 to 5 illustrate frequency response characteristics when the sensitivity is adjusted in Embodiment. FIG. 3 illustrates that the wiper of the variable resistor VR is in a center position, and FIG. 4 illustrates that the wiper of the variable resistor VR takes 0 as a resistance value at a left end in FIG. 1, that is, on the output side of the non-inverting amplifier 1, and a maximum resistance value on an output side of the inverting amplifier 2. The sensitivity of the microphone in this case is about two times as the time when the wiper is in the center. By contrast with this, FIG. 5 illustrates that the wiper of the variable resistor VR takes a maximum resistance value at a right end in FIG. 1, that is, on the output side of the non-inverting amplifier 1, and 0 as a resistance value on the output side of the inverting amplifier 2. The sensitivity of the microphone in this case is about half compared to the time when the wiper is in the center. In both cases, the sensitivity is measured when a sound source is in the front, that is, at 0 degree, at a position of 90 degrees, and in the back, that is, at 180 degrees, and a bold line indicates 0 degree, a middle line indicates 90 degrees, and a thin line indicates 180 degrees.

The sensitivity is −26.4 dBV when the wiper of the variable resistor VR is in the center position, and is maximum when the wiper is at the left end in FIG. 1 and −19.3 dBV which is +7.1 dBV higher than when the wiper is in the center position. Further, the sensitivity is minimum when the wiper is at the right end in FIG. 1, and is −33.1 dBV which is −6.7 dBV lower than when the wiper is in the center position.

In addition, the characteristic diagrams illustrated in FIGS. 3 to 5 illustrate that normalization is performed at an output level at a specific frequency. The characteristic diagrams illustrated in FIGS. 3 to 5 virtually overlap. The reason is that, as described above, even if the sensitivity is adjusted, the voltage between the fixed pole 51 and the diaphragm 52 does not fluctuate, and acoustic characteristics do not fluctuate.

Embodiment 2

Figure 2:
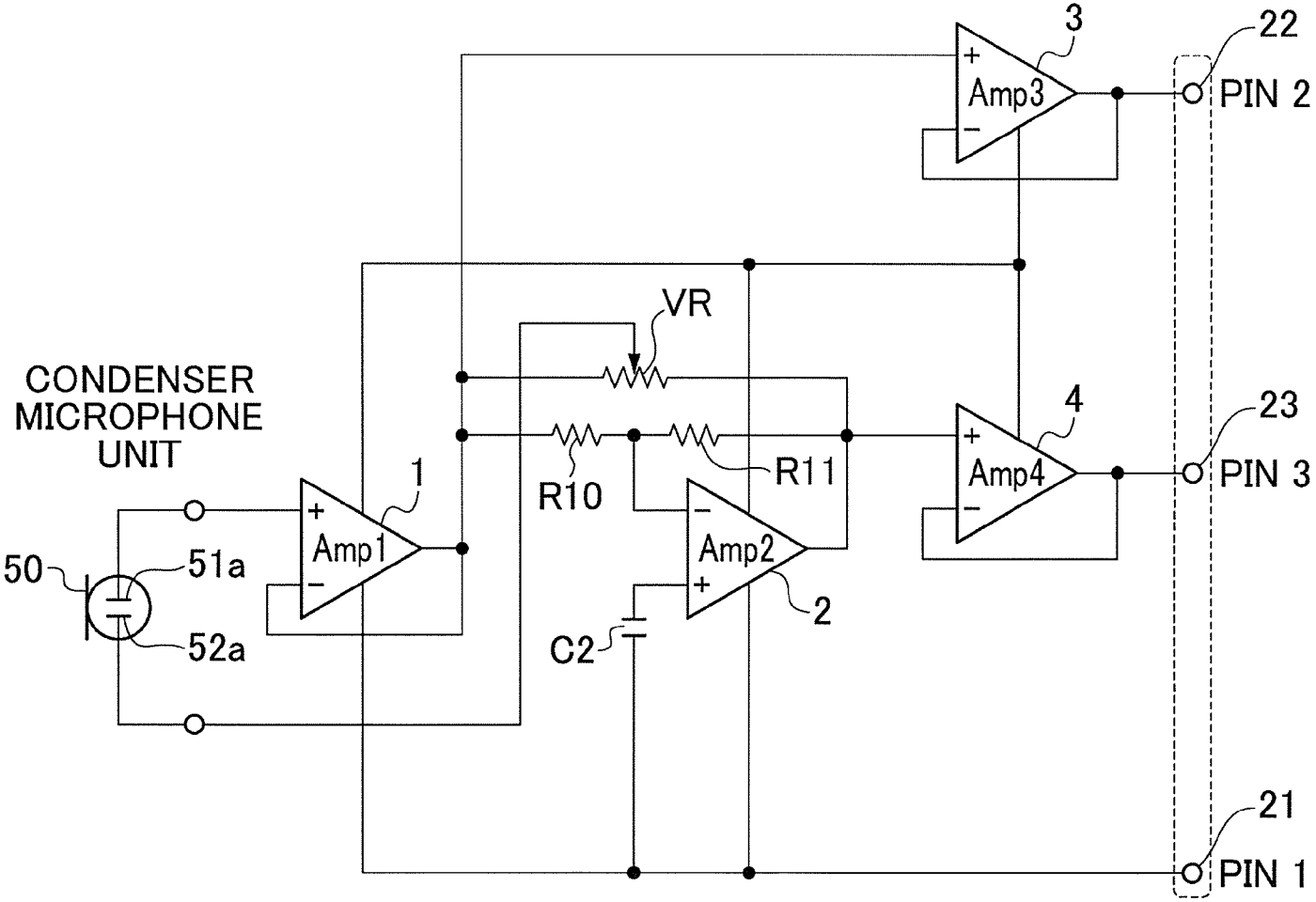
FIG. 2 is a circuit diagram illustrating another Embodiment of a condenser microphone according to the present invention.

The present invention is applicable even when a microphone unit 5 is an electret condenser microphone unit. FIG. 2 illustrates Embodiment of the electret condenser microphone unit. With an electret condenser microphone unit 50, a diaphragm 52*a* or a fixed pole 51*a* has an electret layer. A surface potential of an electret is maintained constant, and a fixed polarization voltage is produced between the diaphragm 52*a* and the fixed pole 51*a*. Consequently, according to Embodiment illustrated in FIG. 2, a direct current voltage does not need to be applied to the electret condenser microphone unit 5, and therefore a direct current power supply 6 as is used in Embodiment 1 illustrated in FIG. 1 is not necessary.

The condenser microphone according to Embodiment 2 illustrated in FIG. 2 employs the same configuration as in Embodiment 1 illustrated in FIG. 1 except that the electret condenser microphone unit 50 is used as described above and the direct current power source 6 is not provided. That is, the condenser microphone according to Embodiment 2 has first to fourth amplifiers 1, 2, 3 and 4. Further, the condenser microphone according to Embodiment 2 has an input resistance R10 connected between an output terminal of a non-inverting amplifier 1 which is a first amplifier and an inverting input terminal of the inverting amplifier 2 which is the second amplifier. Furthermore, the condenser microphone according to Embodiment 2 has a feedback resistance R11 connected between an output terminal and the inverting input terminal of the inverting amplifier 2. A value of the input resistance R10 and a value of the feedback resistance R11 are equal. Further, similar to Embodiment 1, the condenser microphone according to Embodiment 2 has a variable resistor VR which adjusts the sensitivity of the microphone and which is connected between an output of the non-inverting amplifier 1 which is the first amplifier and an output of the inverting amplifier 2 which is the second amplifier. A wiper of the variable resistor VR is connected to the diaphragm 52*a* of the condenser microphone unit 5 through a condenser C1. That is, among the diaphragm 52*a* and the fixed pole 51*a*, the wiper is connected to the diaphragm 52*a* that is not connected to the non-inverting amplifier 1.

Note that, each amplifier 1, 2, 3 and 4 receives a supply of power for operating these amplifiers, from an adequate direct current power supply which is not illustrated.

A configuration of adjusting the sensitivity according to Embodiment 2 illustrated in FIG. 2 is the same as a configuration for adjusting the sensitivity according to Embodiment 1, and the principle for adjusting the sensitivity is also the same. Consequently, the condenser microphone according to Embodiment 2 can provide the same effect as the effect provided in Embodiment 1.

Note that, although, with Embodiments illustrated in FIGS. 1 and 2, the fixed poles 51 or 51*a* of the condenser microphone unit 5 or the electret condenser microphone unit 50 is connected to the non-inverting amplifier 1 which is the first amplifier, and the diaphragm 52 or 52*a* is connected to the wiper of the variable resistor VR, the fixed pole 51 or 51*a* and the diaphragm 52 or 52*a* may be inversely connected. In this case, the phase of an output signal of the condenser microphone unit 5 or the electret condenser microphone unit 50 becomes inverse. Hence, the phase is corrected in circuits from an output of the condenser microphone unit 5 or the electret condenser microphone unit 50 to an output of the microphone such that the phase of an output signal of the microphone has a predetermined phase.

According to the condenser microphone according to above-described Embodiments, a diaphragm or a fixed pole whichever is not connected to an inverting amplifier is driven by the voltage of a wiper of a variable resistor, and an output level of the condenser microphone unit with respect to an earth is adjusted according to the position of the wiper of the variable resistor. According to above-described Embodiments, the voltage (polarization voltage) between the diaphragm and the fixed pole of the condenser microphone unit does not fluctuate, so that it is possible to prevent problems such as electrostatic absorption of the diaphragm due to sensitivity adjustment and fluctuation of acoustic characteristics.

What is claimed is:

1. A condenser microphone comprising:

a condenser microphone unit which comprises a diaphragm and a fixed pole arranged to oppose to the diaphragm, and performs electroacoustic conversion according to a change in an electrostatic capacitance between the diaphragm and the fixed pole;

a non-inverting amplifier which is connected to one of the diaphragm and the fixed pole, and which comprises an impedance converter which converts an output impedance of the condenser microphone unit into a low impedance;

an inverting amplifier receives an output signal of the non-inverting amplifier; and a variable resistor which is connected between an output of the non-inverting amplifier and an output of the inverting amplifier, and in which a wiper is connected to the diaphragm or the fixed pole, whichever is not connected to the non-inverting amplifier.

2. The condenser microphone according to claim 1, wherein the inverting amplifier comprises a feedback resistance, and which receives the output signal of the non-inverting amplifier through an input resistance; and the variable resistor is connected in parallel to the feedback resistance and the input resistance.

3. The condenser microphone according to claim 2, wherein the feedback resistance is connected in series to the input resistance.

4. The condenser microphone according to claim 1, wherein a fixed voltage is applied between the diaphragm and the fixed pole from a direct current power supply.

5. The condenser microphone according to claim 1, wherein an acoustic signal electroacoustically converted by the condenser microphone unit is supplied as a balanced output from an output of the non-inverting amplifier and an output of the inverting amplifier.

6. The condenser microphone according to claim 1, wherein the fixed pole is connected to the non-inverting amplifier, and the wiper is connected to the diaphragm.

7. The condenser microphone according to claim 5, wherein the condenser microphone unit is an electret condenser microphone unit, and a surface potential of an electret is fixed.

8. The condenser microphone according to claim 1, wherein a value of the feedback resistance and a value of the input resistance are equal.

* * * * *